United States Patent [19]

Barry et al.

[11] Patent Number: 4,909,573

[45] Date of Patent: Mar. 20, 1990

[54] CHILD'S CHAIR

[76] Inventors: Timothy P. Barry, 814 N. 10th, Apt. 6, Lafayette, Ind. 47904; Claire A. Miller, 415 S. Chauncey St., Apt. 3, West Lafayette, Ind. 47906

[21] Appl. No.: 327,753

[22] Filed: Mar. 23, 1989

[51] Int. Cl.[4] ..... A47C 15/00

[52] U.S. Cl. ..... 297/456; 5/420; 5/432; 297/181; 297/464; 297/457

[58] Field of Search ..... 297/181, 259, 452, 454, 297/456, 457; 5/417, 419, 420, 432, 434

[56] References Cited

U.S. PATENT DOCUMENTS

| | | | |
|---|---|---|---|
| 289,115 | 11/1883 | McDonald | 297/485 X |
| D. 294,099 | 2/1988 | Bromberg et al. | D6/611 |
| 2,119,023 | 5/1938 | Pickard | 297/253 |
| 2,663,359 | 12/1953 | Wood | 297/253 |
| 2,961,668 | 11/1960 | Hayes | 5/337 |
| 3,635,528 | 1/1972 | Strom | 297/456 |
| 3,840,916 | 10/1974 | Jennings | 5/327 |
| 3,995,335 | 12/1976 | Neely | 5/432 |
| 4,197,604 | 4/1980 | Nakamura | 5/437 |
| 4,410,214 | 10/1983 | Geschwender | 5/432 X |
| 4,538,310 | 9/1985 | Scott | 5/437 |
| 4,695,092 | 9/1987 | Hittie | 297/181 X |
| 4,739,583 | 7/1988 | Husnik | 297/181 X |

FOREIGN PATENT DOCUMENTS

| | | | |
|---|---|---|---|
| 251130 | 1/1988 | European Pat. Off. | 297/457 |

*Primary Examiner*—Peter R. Brown

*Attorney, Agent, or Firm*—Jeffers, Hoffman & Niewyk

[57] ABSTRACT

A child chair includes a cushioned character and a frame for supporting it upright with a child leaning against the cushioned character. The character has a body with upper and lower pairs of limbs connected thereto, and a seat pad connected between the lower limbs and capable of resting on a support surface when the body is disposed upright. The frame has a rigid skeletal member and an anchor member. The rigid member is composed of base and upright portions disposed within the character body. The base portion can assume a resting position on the support surface and the upright portion rigidly connected and extending in a generally transverse relation to the base portion can support the character body upright when the base position is in its resting position. The anchor member is attached to the rigid member along the base portion thereof and extends forwardly within the seat pad to receive the weight of a child seated on the seat pad and leaning against the cushioned body for anchoring and stabilizing the rigid member in a stationary position upon the support surface with its base portion in the resting position capable of resisting backward tilting of the rigid member due to backward leaning of the child against the cushioned body and the upright portion.

17 Claims, 1 Drawing Sheet

CHILD'S CHAIR

BACKGROUND OF THE INVENTION

The present invention generally relates to a child support device and, more particularly, is concerned with a child chair in the configuration of a stuffed animal and having an internal skeletal frame which uses the weight of the child seated on the chair to maintain the chair stationary and stable.

Various support devices shaped in the configuration of a body of a human, animal or fictional character with limbs, such as arms or legs, that wrap around and hug a child while in an upright seated position have been proposed heretofore. Representative of the prior art are the devices disclosed in Jennings U.S. Pat. No. 3 840,916, Nakamura U.S. Pat. No. 4,197,604 and Scott U.S. Pat. No. 4,538,310. Other somewhat related devices are disclosed in Hayes U.S. Pat. No. 2,961,668, Strom U.S. Pat. No. 3,635,528 and Bromberg et al (Des. 294,099).

These prior art child support devices may function as intended by their designers. However, they all appear to have one common, significant drawback from the standpoint of their stability during use. Either no structure at all or an inadequate one is provided for stabilizing the devices at a stationary position and to assist in supporting the child in an upright seated position.

Consequently, a need exists for an improved construction of such devices which will overcome this drawback without introducing a new one in its place.

SUMMARY OF THE INVENTION

The present invention provides a child chair incorporating an internal skeletal frame construction designed to satisfy the aforementioned need. In accordance with the principles of the present invention, the internal skeletal frame of the chair uses the weight of the child seated on the chair to maintain the chair stationary and to augment the stability of the frame and its ability to withstand rearward leaning forces imposed on it by the child seated on the chair.

Accordingly, the present invention is directed to a frame for a child chair which comprises a substantially rigid member for supporting the chair in an upright position for use, the rigid member being composed of a base portion for assuming a resting position upon a supporting surface and an upright portion rigidly connected at a lower end to a forward end of the base portion and extending upwardly in a transverse relation to the base portion for supporting the chair in the upright position when the base portion in its resting position. An anchor member is attached to the rigid member and extends forwardly of the lower end of the upright portion and forward end of the base portion thereof to receive the weight of a child seated on the chair for anchoring and stabilizing the rigid member in a stationary position upon on the support surface. The base portion, in the resting position, is capable of resisting backward tilting of the rigid member due to backward leaning of a child against the upright portion of the rigid member. The base and upright portions of the rigid member have an L-shaped configuration. The anchor member may be a flexible strip of resilient fabric material attached to a cross member extending between and interconnecting the base portion of the rigid member.

Also, the present invention is directed to a child chair which comprises a cushioned body for receiving thereagainst a child when seated upright, and the frame as defined above for supporting the cushioned body. The base and upright portions of the rigid member of the frame are disposed within cushioned body. The chair also includes a lower pair of limbs connected to the cushioned body and extending generally forewardly thereof, and a seat pad connected to and extending between the lower limbs for resting on the support surface when the cushioned body is supported in the upright position The anchor means of the frame extends within the seat pad. The chair also has an upper pair of limbs connected to the cushioned body and extending generally forwardly thereof with means on their forward ends for detachably attaching the forward limb ends together upon extension of the limbs about a child seated against the cushioned body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
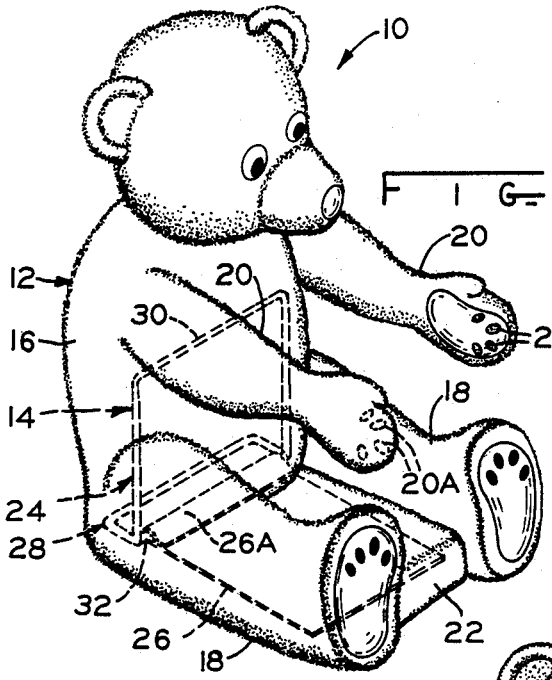
FIG. 1 is a perspective view of a child chair incorporating a skeletal frame within a cushioned body of a stuffed character in accordance with the principles of the present invention, the frame being shown in dashed form and the upper limbs of the character being shown in opened condition.
Figure 2:
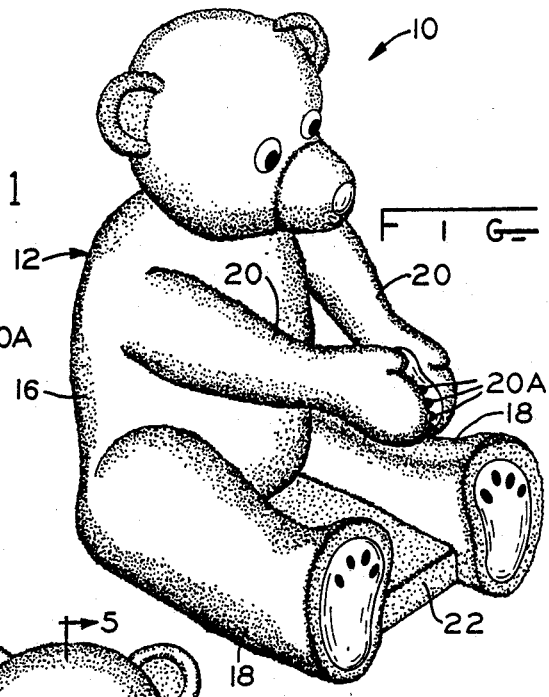
FIG. 2 is a perspective view similar to FIG. 1, but showing the upper limbs of the character in closed condition and not showing the frame.

Referring now to the drawings, and particularly to FIGS. 1 and 2 there is shown a child chair, generally designated by the numeral 10 and constructed in accordance with the principles of the present invention. In its basic components, the child chair 10 includes a cushioned character 12 and frame 14 for supporting it upright with a child leaning against the cushioned character. The cushioned character 12 can have many configurations, such as that of a human, an animal or a fictional character. In the exemplary embodiment herein, it has the configuration of a bear.

More particularly, the cushioned character 12 of the chair 10 has a body 16 and lower and upper pairs of limbs 18, 20 connected thereto and extending forwardly from a front side of the body 16. The cushioned body 16 is composed of a firmer foam padding 16A at its back side for better support and a softer filler 16B at its front side for a soft cushiony feeling. The limbs 18, 20 are filled with medium filler for softness and flexibility. The upper pair of limbs 20 have suitable means, such as Velcro patches 20A, on forward ends (for instance, the claw portions) thereof detachably attaching the forward limb ends together upon extension of the limbs 20 about a child seated against the character body 16.

The chair 10 also includes a seat pad 22 of generally rectangular shape connected between the lower limbs 18 and a bottom side of the body 16. The seat pad 22 is filled with a medium filler also for a soft comfortable seat. The seat pad 22 and lower limbs 18 are capable of resting on a support surface, such as a floor, when the character body 16 is disposed in an upright position on the floor, as shown in FIGS. 1, 2, 4 and 5.

Figure 3:
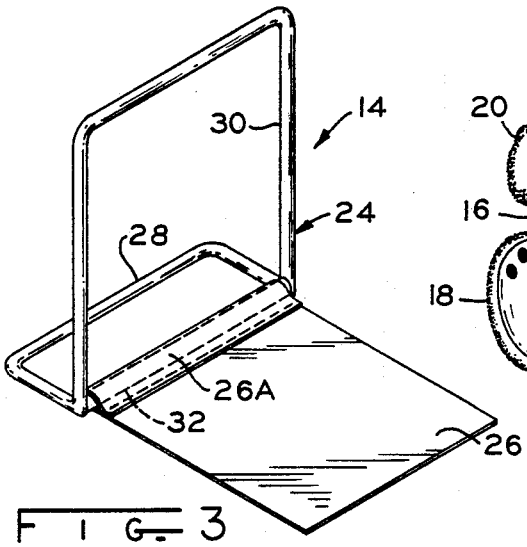
FIG. 3 is a perspective view of the skeletal frame by itself, being disposed in its normal upright condition.
Figure 4:
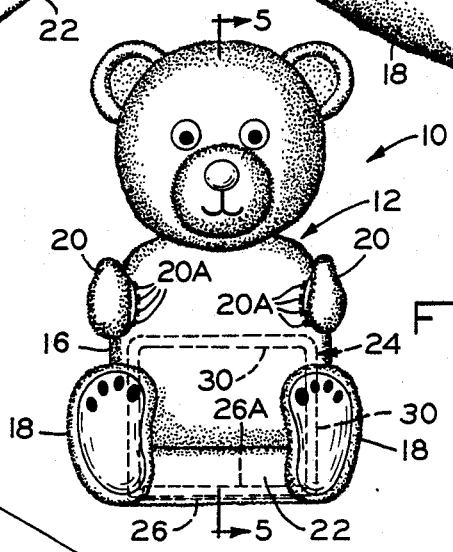
FIG. 4 is a front elevational view, an a smaller scale, of the child chair of FIG. 1.
Figure 5:
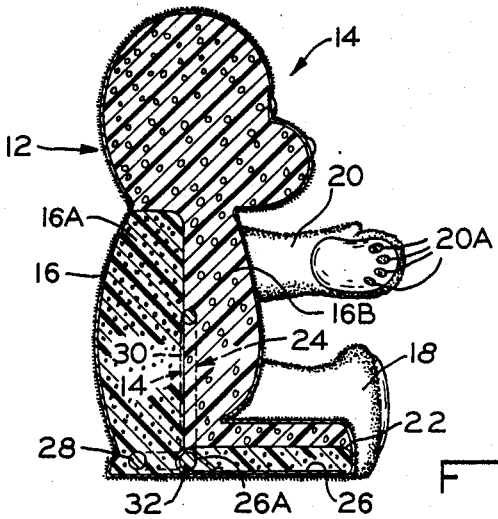
FIG. 5 is a vertical sectional view of the child chair taken along line 5—5 of FIG. 4.

As best seen in FIG. 3, frame 14 of the chair 10 basically includes a rigid skeletal member 24 and an anchor member 26. The rigid member 24 of frame 14 is composed of base and upright portions 28, 30 preferably disposed within the foam material of the cushioned character body 16. The base portion 28 extends within body 16 along the bottom side thereof and can assume a generally horizontal resting position on the floor. The upright portion 20 is rigidly connected and extends from the bottom side toward the top side of body 16 in a generally transverse or perpendicular relation to base portion 28. The upright portion 20 can support the character body 16 in its upright position when the base portion 18 is in the horizontal resting position.

Preferably, the base and upright portions 28, 30 of the rigid member 24 have an overall L-shaped configuration. The base portion 28 preferably has a generally square-cornered U-shaped configuration. The upright portion 30 preferably has a generally square-cornered inverted U-shaped configuration. The base portion 28 and upright portion 30 can be bent into their desired configurations from a single piece of metal tubing. Further, a cross bar 32 is provided in the rigid member 14 extending between and rigidly connected to the forward, end of the base portion 28 and the lower end of the upright portion 30.

The anchor member 26 of the frame 14 is attached to the rigid member 24 along the base portion 28 thereof and extends forwardly past the front side of the body 16 and into the seat pad 22. Although the member 26 can be rigid, it is preferably a flexible strip of resilient fabric material. The flexible anchor member 26 has a looped portion 26A at one end which extends about the cross member 32 for attaching the flexible member thereto The unique function of the anchor member 26 is to receive the weight of a child seated on the seat pad 22 of the chair 10 and leaning against the cushioned body 16. By having the child's weight exerted on it, the anchor member 26 functions to anchor and stabilize the rigid frame member 24 in a stationary position upon the floor with its base portion 28 in its resting position capable of resisting backward tilting of the rigid frame member 24 due to backward leaning of the child against the cushioned body 16 and the upright portion 30 of the rigid frame member 24.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A chair comprising:

a cushioned body for receiving thereagainst an occupant when seated upright;

a rigid frame member including a base portion disposed within said cushioned body for assuming a resting position upon a support surface and an upright portion rigidly connected at a lower end to a forward end of said base portion and extending upwardly within said cushioned body in a generally transverse relation to said base portion for supporting said cushioned body in an upright position when said base portion is in its resting position, said frame member including a cross member extending between said forward and lower ends of said base and upright portions; and means attached to said cross member and extending forwardly in said cushioned body to receive the weight of an occupant seated against said cushioned body for anchoring and stabilizing said rigid frame member in a stationary position upon support surface with said base portion in said resting position, said anchoring means extending generally coplanarly with said base portion, said base portion and said anchoring means positioned on opposite sides of said cross member, said chair capable of resisting backward tilting of said rigid frame member due to backward leaning of the occupant against said cushioned body.

2. The chair as recited in claim 1 which is in the shape of a human or animal figure further comprising:

at least one pair of limbs connected to said cushioned body and extending generally forward thereof; and a seat pad connected to and extending between said limbs for resting on the support surface when said cushioned body is supported in said upright position.

3. The chair as recited in claim 2, wherein said anchoring and stabilizing means extends within said pad.

4. The chair as recited in claim 2, further comprising:

a second pair of limbs connected to said cushioned body and extending generally forwardly thereof; and means on forward ends of said second pair of limbs for detachably attaching said forward limb ends together upon extension of said limbs about a child seated against said cushioned body.

5. The chair as recited in claim 1, wherein said base and upright portions of said rigid frame member have an L-shaped configuration.

6. The chair as recited in claim 1, wherein said base portion has a generally square-cornered U-shaped configuration.

7. The chair as recited in claim 1, wherein said upright portion has a generally square-cornered inverted U-shaped configuration.

8. The chair as recited in claim 1, wherein said anchoring and stabilizing means is a flexible member attached to said cross bar.

9. The chair as recited in claim 8, wherein said flexible member is a flexible strip of fabric material.

10. The chair as recited in claim 8, wherein said flexible member has a looped portion at one end which extends about said cross member for attaching said flexible member to said cross member.

11. A child's chair, comprising:

a cushioned character having a body with opposite bottom and top sides and opposite front and back sides, said character also having upper and lower pairs of limbs connected to said body and extending generally forwardly of said front side thereof;

a seat pad connected to and extending between said lower limbs of said character and connected to said bottom side of said character body, said lower limbs and said seat pad capable of resting on a support surface when said character body is disposed in an upright position;

a rigid skeletal frame member composed of a base portion disposed within said character body at said bottom side thereof for assuming a resting position on the support surface and an upward portion rigidly connected at a lower end to a forward end of said base portion and extending within said character body from adjacent said bottom side toward said top side thereof and in a generally transverse relation to said base portion for supporting said character body in said upright position when said base portion is in its resting position, said frame member including a cross member extending between said forward and lower ends of said base and upright portions; and a flexible member attached to said cross member and extending from said cross member forwardly past said front side of said character body and within said seat pad to receive the weight of a child seated on said seat pad and leaning against said cushioned body, said flexible member anchoring and stabilizing said rigid frame member in a stationary position on the support surface with its base portion in said resting position, said flexible member extending generally coplanarly with said base portion, said base portion and said flexible member positioned on opposite sides of said cross member, said chair capable of resisting backward tilting of said rigid frame member due to backward leaning of the child against said cushioned body and said upright portion of said rigid frame member.

12. The chair as recited in claim 11, wherein said upper pair of limbs have means on forward ends thereof detachably attaching said forward limb ends together upon extension of said limbs about a child seated against said character body.

13. The chair as recited in claim 12, wherein said base and upright frame member form an L-shaped configuration.

14. The chair as recited in claim 11, wherein said flexible member has a looped portion at one end which extends about said cross member for attaching said flexible member to said cross member.

15. The chair as recited in claim 11, wherein said flexible member is a flexible strip of fabric material.

16. A chair comprising:

a cushioned character having a body with opposite bottom and top sides and opposite front and back sides, said character also having upper and lower pairs of limbs connected to said body and extending generally forwardly of said front side thereof, said upper limbs having a length adapted to envelope an occupant seated in the chair;

a seat pad connected to and extending between said lower limbs of said character and connected to said bottom side of said character body, said lower limbs and said seat pad capable of resting on a support surface when said character body is disposed in an upright position, said lower limbs extending along the sides of said seat pad for restraining lateral movement of an occupant seated in the chair;

a rigid frame member including a base portion disposed within said character body at said bottom side thereof for assuming a resting position on the support surface and an upright portion rigidly connected to said base portion and extending within said character body from adjacent said bottom side toward the top side thereof and in a generally transverse relation to said base portion for supporting said character body in said upright position when said base portion is in its resting position, said base portion extending rearwardly of said upright portion; and an anchor member connected to said frame member and extending forwardly of said upright portion within said seat pad to receive the weight of an occupant seated on said seat pad for anchoring and stabilizing said rigid frame member in a stationary position on the support surface with its base portion in the resting position, said chair capable of resisting backward tilting of said frame member due to backward leaning of the occupant against said cushioned body.

17. The chair as recited in claim 16 wherein said upper pair of limbs have means on forward ends thereof detachably attaching said forward limb ends together upon extension of said limbs about an occupant seated against said character body.

* * * * *